US006692377B2

(12) United States Patent
Galloway

(10) Patent No.: US 6,692,377 B2
(45) Date of Patent: Feb. 17, 2004

(54) GRAPHITE SHAFT WITH FOIL MODIFIED TORSION

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/065,962

(22) Filed: Dec. 4, 2002

(65) Prior Publication Data

US 2003/0119598 A1 Jun. 26, 2003

Related U.S. Application Data

(63) Continuation-in-part of application No. 60/342,795, filed on Dec. 21, 2001.

(51) Int. Cl.[7] ..... A63B 53/10; A63B 53/12
(52) U.S. Cl. ..... 473/321; 156/188
(58) Field of Search ..... 473/316–323; 156/188

(56) References Cited

U.S. PATENT DOCUMENTS 5,028,464 A * 7/1991 Shigetoh ..... 428/35.9
5,071,687 A * 12/1991 Shigetoh ..... 428/35.9
5,088,735 A 2/1992 Shigetoh
5,259,614 A 11/1993 Greer

FOREIGN PATENT DOCUMENTS

| | | | |
|---|---|---|---|
| EP | 0 761 419 | | 3/1997 |
| GB | 555027 | | 7/1943 |
| GB | 2 226 380 | | 6/1990 |
| JP | 5-161729 | * | 6/1993 |
| JP | 10-43334 | * | 2/1998 |
| JP | 11-4918 | * | 1/1999 |
| JP | 11-244434 | * | 9/1999 |

* cited by examiner

*Primary Examiner*—Stephen Blau
(74) *Attorney, Agent, or Firm*—Michael A. Catania; Elaine H. Lo

(57) ABSTRACT

An improved golf club shaft is disclosed. The golf club shaft includes a shaft body made of a composite material, such as carbon/epoxy, and a metal foil wrapped in a spiral pattern around at least a portion of the shaft body. The metal foil increases the torsional stiffness of the shaft and improves its bending stiffness, thereby enabling the first and second frequencies of a golf club employing the shaft to remain in a desired range.

3 Claims, 6 Drawing Sheets

FIG. 1
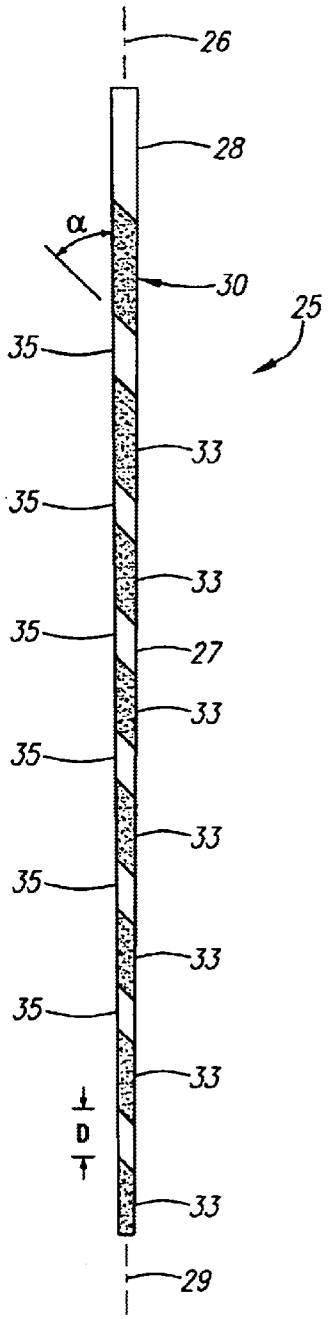
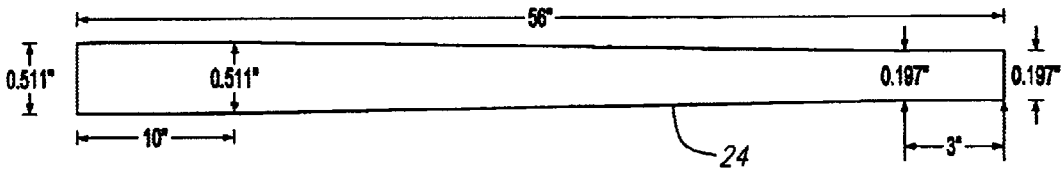
FIG. 2

GRAPHITE SHAFT WITH FOIL MODIFIED TORSION

CROSS REFERENCE TO RELATED APPLICATIONS

This application is a continuation-in-part of a provisional application, U.S. patent application Ser. No. 60/342,795, filed on Dec. 21, 2001.

FEDERAL RESEARCH STATEMENT

Not Applicable

BACKGROUND OF INVENTION

1. Field of the Invention

The present invention relates to a golf club shaft having different modal frequencies to improve both the swing feedback and post-impact harshness of a golf club. More specifically, the present invention relates to the improvement of a golf shaft by utilization of one or more layers of foil in specifically oriented directions to increase the performance of the golf club shaft upon impact with a golf ball.

2. Description of the Related Art

Golf clubs are an assembly of a club head, shaft, grip and miscellaneous adapter and/or finish components. The shafts have been made from wood and then metal (steel, aluminum, titanium and metal matrix materials). Composite materials, such as glass/epoxy and carbon/epoxy, have also been utilized. The majority of shafts are now either steel or carbon/epoxy, although hybrid shafts that combine steel or titanium with carbon/epoxy can also be found.

Shafts are designed with various bending and torsional stiffnesses and weights to accommodate customer preferences. Shafts are categorized and marketed by these parameters and the associated club parameter, first frequency. Golf literature attributes a wide range of performance differences to small changes in shaft and shaft driven club parameters, the significant of these parameters being primarily club mass, mass distribution and feel. The shaft role in feel is first in feedback of the inertial forces (resistance) and therefore the path of the head during back swing and down swing. Mass, mass distribution and the first bending mode are of interest for these motions. Secondly, the shaft feel contribution is independent of swing after ball impact. The impact location and energy determines the amplitude of excitation of the various natural modes of the club.

The shaft plays a principal role in defining the mode shapes and frequencies and in transmitting the vibrations to the golfer's hands. The first mode frequencies have been shown in a range of non-golf studies to be frequencies that reinforce learning and are generally relaxing and pleasurable. These modes are energized for club head-ball impact that acts through or close to the head center of mass. The third mode for most clubs combines bending and torsion. This mode's natural frequency is typically in a frequency range of 35 to 60 hertz and higher ranges. This particular frequency range matches well with nerve receptors in the hands and is often interpreted by golfers as harsh and unpleasant. The inertial properties of the head affect this club mode, and a high inertia about the shaft axis mass reduces the impact energy driving this mode. For heads with odd inertial coupling or low inertia, the impact will excite the golf clubs, causing a harsh feel, particularly for off-center hits. Modifying the torsional stiffness of a shaft can change the higher frequencies of a golf club and result in an overall improvement in satisfaction. Dampening can increase the decay of a harsh vibration, however, it can also mask the sought after reinforcing feedback. Steel shafts have a high torsional stiffness and are preferred by some players, but lack the low mass and natural dampening of carbon/epoxy shafts. Increasing the torsional stiffness of a shaft can decrease the amplitude of the combined modes and shift frequencies, as it will take more impact energy to achieve the same harshness thresholds. Carbon shafts provide the capability, through fiber selections and combinations along with fiber placement and orientation, to tune the club modes to achieve a generally superior combination of club modes. However, the carbon/epoxy shaft must typically utilize large tube selections, high modulus fibers and high percentages of 45° plies to achieve the feel combinations sought by golfers. The diameters have traditionally been the same for steel and carbon shafts, but this is now changing. The cost of higher modulus fibers adds to the production cost of the club. Attempts to improve club feel by increasing passive dampening have had only limited success. In golf clubs, the elastic, loss, and mass properties of the shaft combined with the head, grip and any other components result in structures that have specific vibration mode shapes, frequencies and decays. Some of these frequencies and mode shapes enhance the feel and perception for the golfer. These are typically the lower frequency modes, usually the first and second bending modes.

Mode frequencies are routinely measured in golf clubs and are used as measures of shaft and club quality and performance. Clubs and shafts are fit to specific player segments based on designed to and measured parameters. The parameters include: club frequency in a clamped condition; shaft frequency with a representative head mass; shaft-bending deflection under an arbitrary load case; and shaft deflected profile under an arbitrary load case. These parameters correlate to club modes. The actual frequencies in play are actually different from the static measurements due to an extension force on the shaft pulling the head into a near circular path during a swing.

There remains a need for golf club shafts that have a high torsional stiffness and a low bending stiffness while simultaneously maintaining the frequencies of the club and shaft in a range that is desirable to the golfer.

SUMMARY OF INVENTION

The present invention provides a golf club shaft that includes a carbon/epoxy shaft body wrapped with one or more layers of foil to increase the torsional stiffness of the shaft while maintaining the golf club's modal frequencies in a range that is more desirable to the golfer than other golf clubs.

One aspect of the present invention is the use of a nearly standard carbon/epoxy shaft with one or more layers of steel, steel alloy, titanium, titanium alloy or other metal foils. The metal foil is discontinuous in a longitudinal direction, but continuous in a torsional direction, thus producing a spiral. The metal foil is wrapped at or near the extreme diameter of the shaft and stiffens the shaft torsionally, thereby increasing the frequency and excitation energies of the torsional modes. The first combined mode is usually the first torsional mode, which often falls into the frequencies deemed by golfers to be harsh.

This aspect improves the bending stiffness of the club while adding mass, such that the first and second frequencies of the shaft and the club remain in the desired range of modal frequency, typically 2–10 hertz. The mass of the foil along the outer portion of the shaft also helps to dampen the torsional impulse of an off-center ball impact, although the club head is often the primary component that dampens this impulse. If designed to do so, the grip can attenuate vibration at higher frequencies.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

FIG. 1 is a front plan view of a golf club shaft in accordance with the present invention.

FIG. 2 is an illustration of a mandrel that may be used when manufacturing a golf club shaft in accordance with the present invention.

DETAILED DESCRIPTION

The present invention is directed to a golf club with an improved shaft that maintains the golf club's modal frequencies in a range that is desirable to a golfer. The golf club shaft includes a carbon/epoxy shaft with one or more layers of foil wrapped around the shaft to increase the torsional stiffness of the golf club shaft while maintaining the golf club's modal frequencies in a desired range.

As shown in FIG. 1, the shaft 25 includes a substantially rigid shaft body 27 having a proximal end 28 and a distal end 29. The shaft body 27 generally has the shape of a gradually tapered cylindrical tube. Alternatively, the shaft body 27 may have a substantially uniform cross-section, a flared tip, or numerous other configurations.

Figure 5:
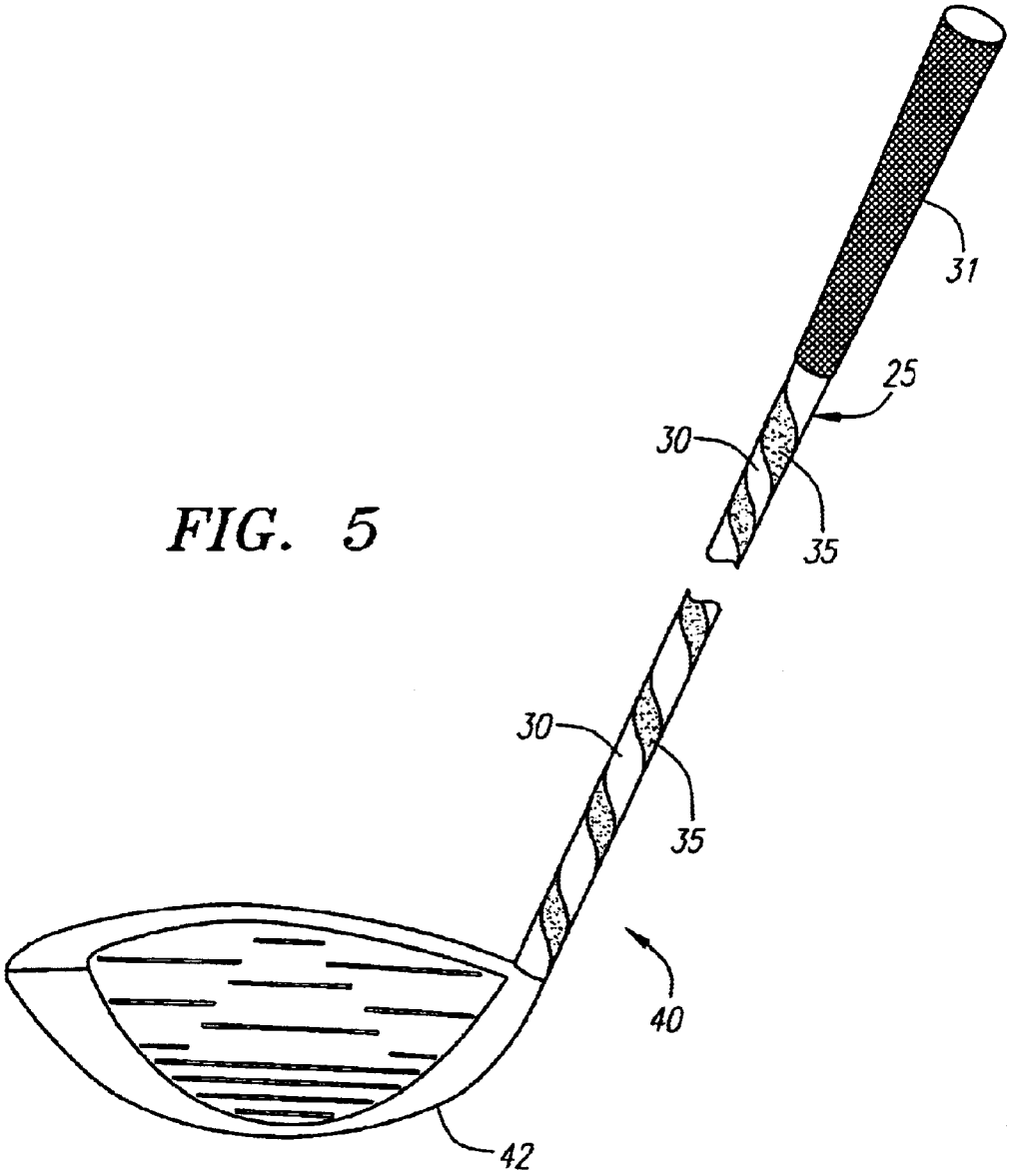
FIG. 5 is a perspective view of a golf club having a golf club shaft in accordance with the present invention.

The proximal end 28 of the shaft body 27 includes a grip 31 (FIG. 5). The grip 31 may have a predetermined grip geometry or ornamental pattern embossed thereon and may be manufactured in accordance with the molding process described in U.S. Pat. No. 6,352,662, entitled Integral Molded Grip and Shaft, which is incorporated by reference herein in its entirety.

The shaft body 27 may be manufactured from a variety of composite materials including carbon/epoxy, fiberglass/epoxy, steel/epoxy, hybrid combinations of steel or titanium and carbon/epoxy, or any other composite combinations well known in the art. A preferred material for the golf club shaft body 27 of the present invention is a carbon/epoxy composite. The shaft body 27 may then be wrapped with one or more layers of metal foil 30 to provide a better combination of torsion and bending stiffness while adding mass such that the first and second frequencies of the resulting golf club remain in a frequency range desired by a golfer. A preferred first frequency range is between 2 to 10 hertz and more preferably between 3 to 5 hertz.

The metal foil 30, may comprise steel, stainless steel, steel alloys, titanium, titanium alloys, tin, other metals and/or ceramics. The metal foil 30 is placed about the shaft body 27 such that the foil 30 is continuous along a torsional direction and discontinuous along a longitudinal direction, thereby forming a spiral along the shaft body 27. The foil 30 may run the entire length of the golf club shaft 25 or along only a portion thereof. Additionally, the metal foil 30 may create a plurality of spirals 33 along the length of the shaft ranging anywhere from 3–30 spirals.

The metal foil 30 is preferably placed at an angle $\alpha$ of approximately 45 degrees with respect to the shaft axis 26. The angle $\alpha$ will vary as a result of the outer diameter profiles of the shaft body 27 along its length. The angle $\alpha$ may range from approximately 30 degrees to approximately 70 degrees, more preferably from 35 degrees to 65 degrees, and most preferably from 40 degrees to 50 degrees. The metal foil 30 may be placed along an inner graphite layer of the golf club shaft 25. Alternatively, the metal foil 30 may be placed on a middle graphite layer of the golf club shaft with a layer of graphite sheet placed over the metal foil, or on an outer layer of the club shaft body with or without an additional layer of graphite sheet placed over the metal foil.

Figure 4:
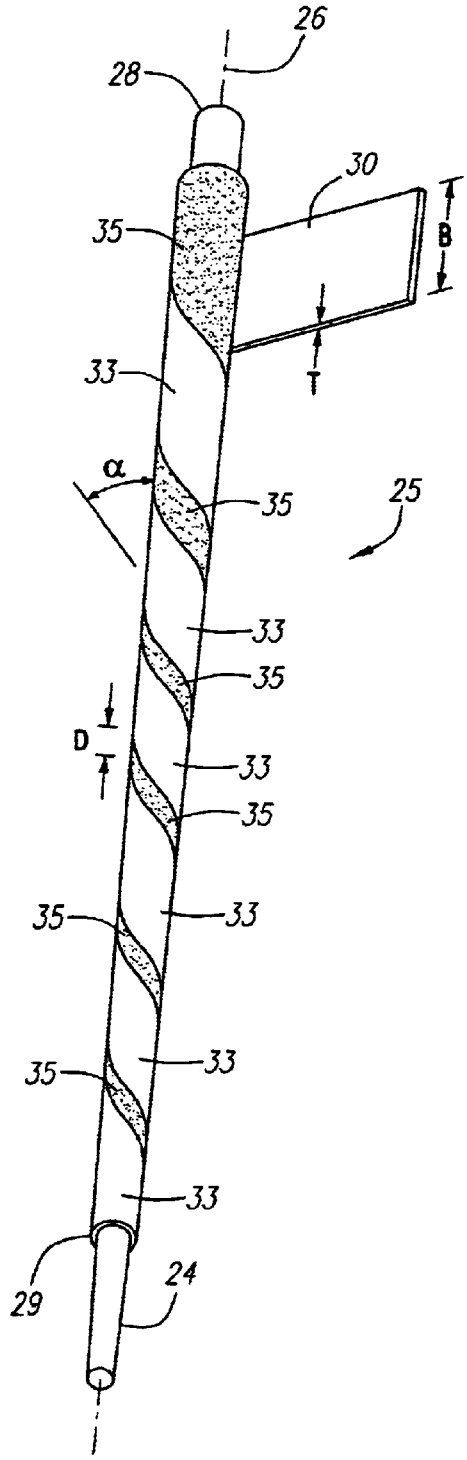
FIG. 4 is a perspective view of a metal foil wrapped around plies of pre-preg, which are in turn wrapped around a mandrel.

As illustrated in FIG. 4, the metal foil 30 has a thickness T that ranges from 0.001 inch to 0.250 inch, more preferably from 0.001 inch to 0.100 inch, and even more preferably from 0.002 inch to 0.006 inch. The foil 30 has a width W that ranges from 0.25 inch to 2.0 inches, and more preferably from 0.50 inch to 1.5 inches. One of ordinary skill in the art will appreciate that the thickness T and the width W of the metal foil 30 need not be constant along the length of the metal foil 30. One or both of the thickness T and width W may vary within the preferred ranges. A distance D, which is the spacing between adjacent spirals 33 of the metal foil 30, may vary from 0.12 inch at the distal end 29 of the shaft 25 to 2.0 inches at the proximal end 28 of the shaft 25. The distance D is preferably between 0.12 inch and 0.60 inch at the distal end 29 and between 0.50 inch and 2.0 inches at the proximal end 28.

The shaft 25 is designed to enhance the resulting golf club's reinforcing frequencies, such as the 2 hertz static (4 hertz during a golf swing), bending frequencies while simultaneously moving the harshness modes typical of the first combined mode to higher frequencies. The spiral wrap configuration of the metal foil 30, which has a higher density and greater stiffness, about the composite shaft body 27 allows for these preferred modal frequency goals.

The metal foil 30 outer layer may be combined with an intermediate high loss dampening layer and an internal graphite shaft to achieve a torsion mass dampening function similar in principle and execution to torsion dampers used in machinery, such as automobile engines.

Figure 1A:
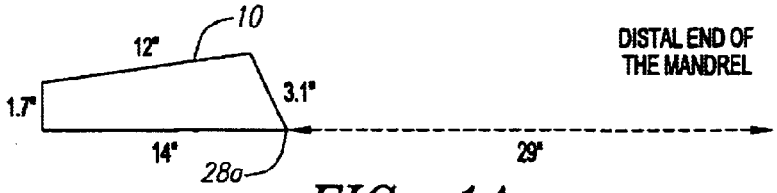
FIGS. 1A–1G illustrate a set of plies of pre-preg carbon fiber sheets that may be used to manufacture a golf club shaft in accordance with the present invention.
Figure 1B:
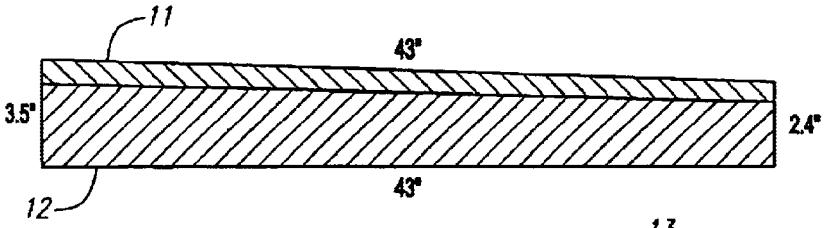
Figure 1C:
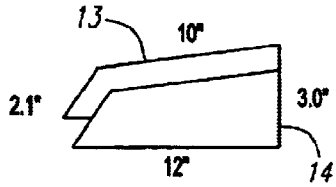
Figure 1D:
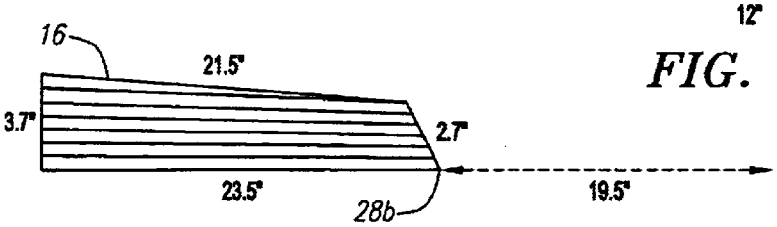
Figure 1E:
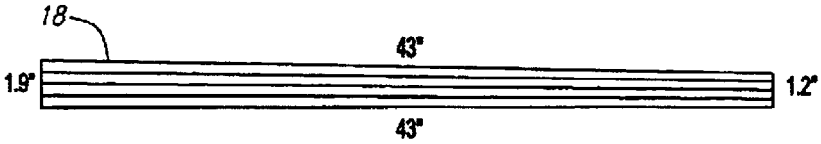
Figure 1F:
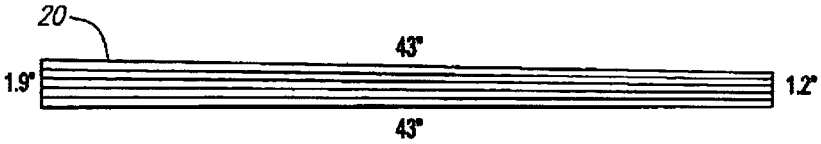
Figure 1G:
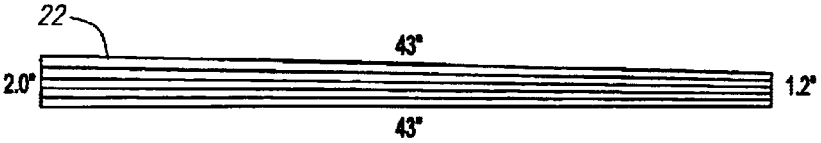
Figure 3:
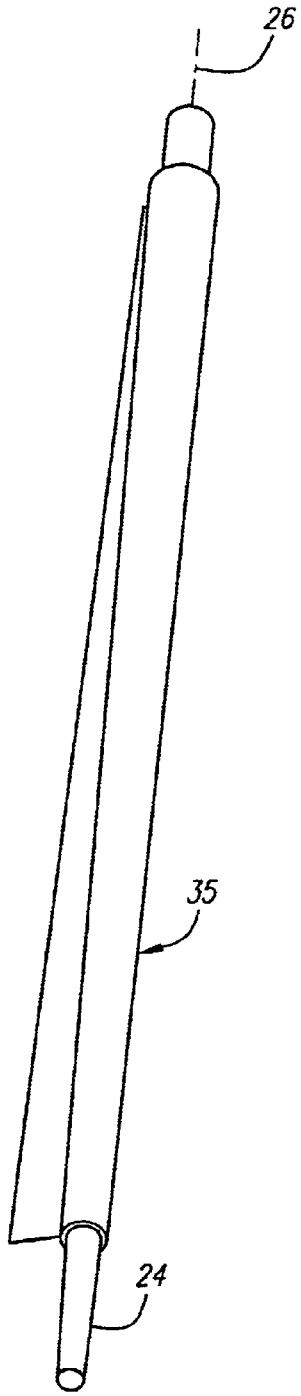
FIG. 3 is a view of several plies of pre-preg carbon fiber sheets wrapped around a mandrel.

Referring now to FIGS. 1A–1G and 2–4, the manufacture of the golf club shaft 25 will now be discussed. FIGS. 1A–1G provide an illustration of a set of plies of pre-preg carbon fiber sheets 10–22. The dimensions and relative positions of the plies of pre-preg carbon fiber sheets 10–22 are determined, and the set of plies 10–22 to be used in the shaft is prepared. A mandrel 24, shown in FIG. 2, having predefined dimensions is selected and covered by a bladder (not shown). The plies 10–22 are then wrapped around the bladder-covered mandrel 24 in a predetermined manner. FIG. 3 illustrates the combined plies, collectively identified by reference numeral 35, wrapped around the mandrel 24. Further information on this manufacture process may be found in U.S. Pat. Nos. 6,126,557 and 6,490,960, both of which are entitled Golf Club Shafts and Methods of Manufacturing the Same and are incorporated by reference herein in their entirety.

In FIG. 4 the metal foil 30 is then wrapped around the wrapped plies of pre-preg carbon fiber sheets 35. An adhesive (not shown) is preferably used to adhere the metal foil 30 to the pre-preg carbon fiber sheets 35. The adhesive layer is preferably a viscoelastic material that may provide viscous dampening between the pre-preg carbon fiber sheets 35 and the metal foil 30. Alternatively, an outer layer of pre-preg carbon fiber or other material (not shown) may be wrapped over the metal foil 30, and this outer layer is adhered to the exposed portions of the inner pre-preg carbon-fiber sheets 35 to secure the metal foil 30 to the shaft body 27. In addition, multiple layers of metal foil 30 may also be used in an alternative embodiment, wherein pre-preg carbon fiber sheets lie between the layers of metal foil.

After the plies of pre-preg carbon fibers 35 and the metal foil 30 are wrapped around the mandrel 24, the wrapped mandrel is placed in a mold (not shown). The mandrel 24 may be withdrawn from the bladder, leaving the bladder and the surrounding plies and metal foil in the mold. A source of pressurized gas may then be used to inflate the bladder and force the metal foil 30 and the plies of pre-preg carbon fiber 35 against the walls of the mold. The mold may then be placed in an oven for a selected period of time to allow proper curing of the resin comprising the various plies. Thereafter, the mold may be removed from the oven and allowed to cool. The shaft 25 is then removed from the mold, and the bladder is removed from the core of the shaft 25. This bladder molding method produces a shaft with a smooth finish.

An alternative method of manufacturing the shaft 25, which uses a tape wrap rather than a bladder, may also be used. In this method, the plies of pre-preg carbon fiber sheets 30 and the metal foil 30 are wrapped directly around the mandrel 24. The wrapped mandrel is then covered with a film tape (not shown), such as a cello wrap. The film tape applies moderate pressure to consolidate and secure the materials in place during an oven cure. After the materials have cured, the film tape and mandrel 24 are removed, and the shaft 25 is ready for finish sanding and trimming.

FIG. 5 illustrates a golf club 40 including a golf club head 42 and the shaft 25 in accordance with the present invention. The golf club 40 with the shaft 25, which has a high torsional stiffness and a low bending stiffness, maintains the frequencies of the golf club 40 in a range that is desirable to the golfer. Those skilled in the art will appreciate, that although the golf club 40 is illustrated as a wood-type golf club, the shaft 25 may be also be applied to other types of golf clubs, such as iron-type golf clubs.

Figure 6:
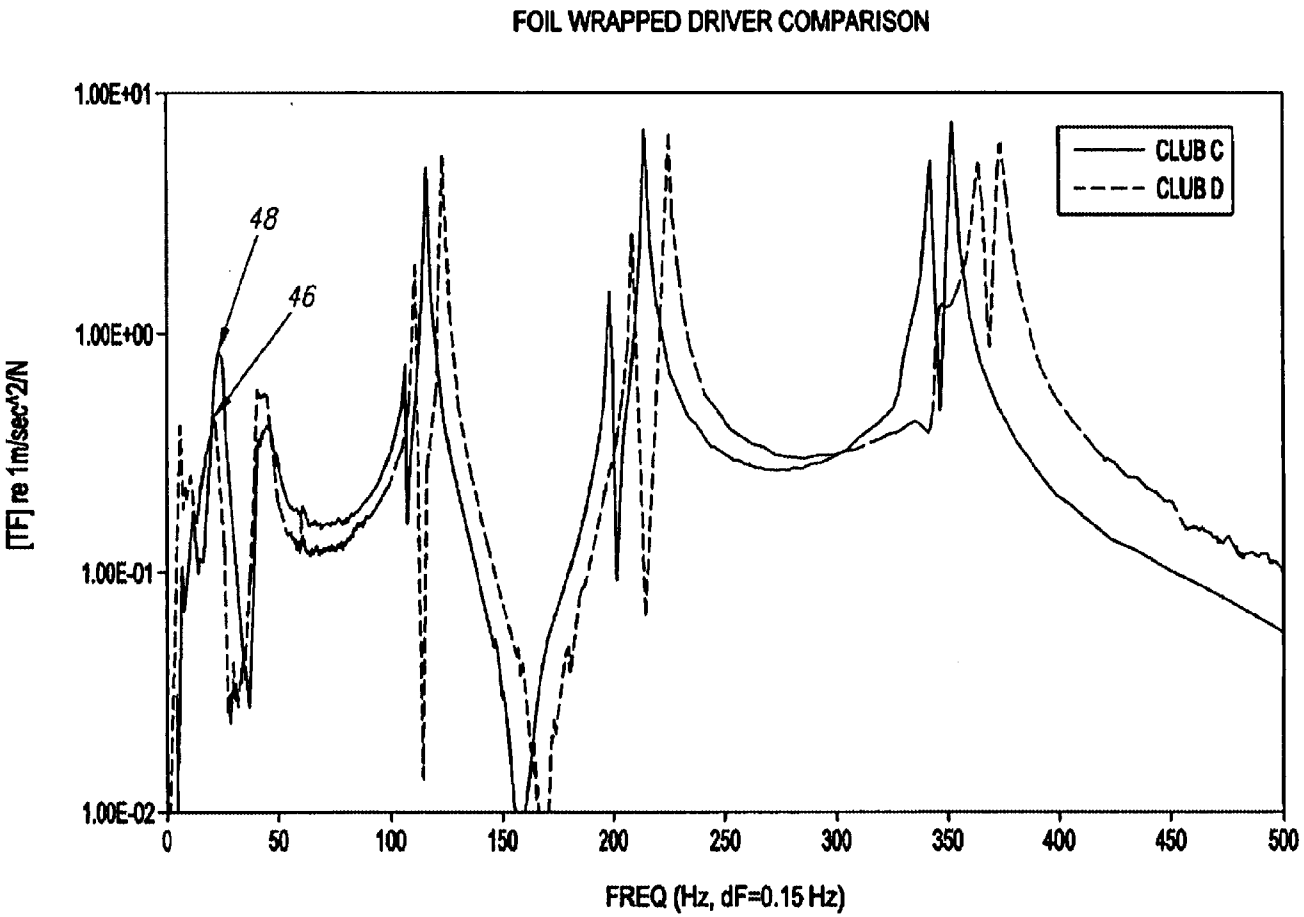
FIG. 6 is a chart of transfer function magnitude versus frequency for two wood-type golf clubs, one of which employs a golf club shaft in accordance with the present invention.
Figure 7:
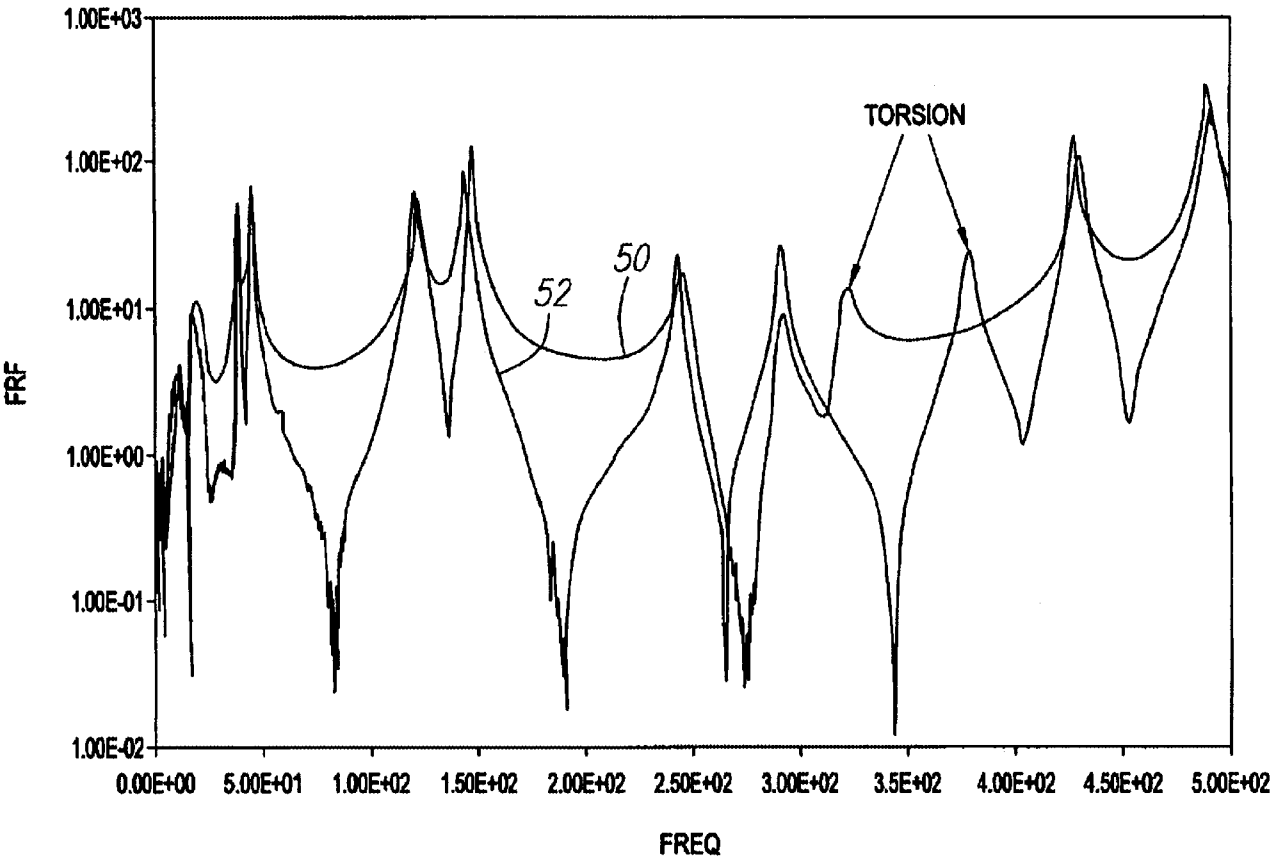
FIG. 7 is a chart of transfer function magnitude versus frequency for two iron-type golf clubs, one of which employs a golf club shaft in accordance with the present invention.

FIG. 6 is a chart comparing the transfer function magnitude versus frequency data for two different wood-type golf clubs: a driver 46 incorporating a shaft in accordance with the present invention; and a driver 48 having an unmodified shaft. FIG. 7 is a chart comparing the transfer function magnitude versus frequency data for two different iron-type golf clubs; an iron 50 incorporating a shaft in accordance with the present invention; and an iron 52 having a constant weight steel shaft. The data shows that the golf shaft of the present invention can shift the peaks in frequency as well as decrease the amplitude, compared to clubs that lack a foil-modified shaft.

From the foregoing it is believed that those skilled in the pertinent art will recognize the meritorious advancement of this invention and will readily understand that while the present invention has been described in association with a preferred embodiment thereof illustrated in the accompanying drawings, numerous changes, modifications and substitutions of equivalents may be made therein without departing from the spirit and scope of this invention, which is intended to be unlimited by the foregoing except as may appear in the following appended claims. Therefore, the embodiments of the present invention in which an exclusive property or privilege is claimed are defined in the following appended claims.

What is claimed is:

1. A golf club shaft comprising:

a shaft body composed of a plurality of pre-preg carbon fiber sheets, the shaft body having a proximal end and a distal end;

a metal foil wrapped around an outer surface of pre-preg carbon fiber sheets of the shaft body in a spiral pattern such that adjacent spirals are spaced apart from each other by a distance ranging from 0.12 inch to 2.0 inches with spirals at the distal end spaced apart from each other a distance ranging from 0.12 inch to 0.6 inch and spirals at the proximal end spaced apart from each other a distance ranging from 0.5 inch to 2.0 inch, the metal foil extending at an angle between 35 degrees and 50 degrees with respect to a longitudinal axis of the shaft body and having a thickness ranging from at least 0.002 inch to 0.006 inch and a width ranging from 0.25 inch to 2.0 inches, the metal foil composed of a steel alloy material; and an adhesive layer disposed between the metal foil and the outer surface of pre-preg carbon fiber sheets, the adhesive layer composed of a viscoelastic material to provide viscous dampening between the metal foil and the plurality of pre-preg carbon fiber sheets, wherein the metal foil increases a torsional stiffness of the shaft body while minimally increasing a bending stiffness of the shaft body, the metal foil further providing torsional dampening to the composite shaft body.

2. A golf club comprising:

a club head; and a shaft having a distal end and a proximal end, the distal end of the shaft being coupled to the club head, the shaft including:

a composite shaft body composed of a plurality of pre-preg carbon fiber sheets, a metal foil wrapped around an outer surface of the shaft body and extending at an angle between 35 degrees and 50 degrees with respect to a longitudinal axis of the shaft body, the metal foil forming a plurality of spirals along the shaft body, each spiral being spaced apart from an adjacent spiral by a distance ranging from 0.12 inch to 2.0 inches with spirals at the distal end spaced apart from each other a distance ranging from 0.12 inch to 0.6 inch and spirals at the proximal end spaced apart from each other a distance ranging from 0.5 inch to 2.0 inches, the metal foil having a thickness ranging from at least 0.002 inch to 0.006 inch and a width ranging from 0.25 inch to 2.0 inches, the metal foil composed of a steel alloy material, and an adhesive layer disposed between the metal foil and the composite shaft body, the adhesive layer composed of a viscoelastic material to provide viscous dampening between the metal foil and the composite shaft body, wherein the metal foil increases a torsional stiffness of the shaft body while minimally increasing a bending stiffness of the shaft body to provide the golf club with a first frequency ranging from 2 Hertz to 10 Hertz, the metal foil further providing torsional dampening to the composite shaft body.

3. A method for manufacturing a golf club shaft comprising:

wrapping a plurality of pre-preg carbon fiber sheets around a bladder covered mandrel to form a shaft body with a distal end and a proximal end;

wrapping a metal foil over an outer surface of the plurality of pre-preg sheets of the shaft body, the metal foil extending at an angle between 35 degrees and 50 degrees with respect to a longitudinal axis of the shaft body and having a thickness of at least 0.002 inch to 0.006 inch and a width ranging from 0.25 inch to 2.0 inches, the metal foil forming a plurality of spirals along the shaft body, each spiral being spaced apart from an adjacent spiral by a distance ranging from 0.12 inch to 2.0 inches with spirals at the distal end spaced apart from each other a distance ranging from 0.12 inch to 0.6 inch and spirals at the proximal end spaced apart from each other a distance ranging from 0.5 inch to 2.0 inches, the metal foil composed of a steel alloy material, the metal foil having a viscoelastic material to adhere to the plurality of pre-preg carbon fiber sheets;

placing the wrapped bladder covered mandrel in a mold;

removing the mandrel to leave the bladder and wrapped plurality of pre-preg carbon fiber sheets and metal foil in the mold;

bladder molding the wrapped plurality of pre-preg carbon fiber sheets and metal foil to create a shaft with a spiral metal foil;

wherein wrapping the metal foil provides torsional dampening to the shaft and increases a torsional stiffness of the shaft while minimally increasing a bending stiffness of the shaft.

* * * * *